United States Patent [19]

Foster et al.

[11] B 3,991,251

[45] Nov. 9, 1976

[54] TREATMENT OF ASBESTOS DIAPHRAGMS AND RESULTING DIAPHRAGM

[75] Inventors: Robbie T. Foster; William B. Darlington; Malcolm Korach, all of Corpus Christi, Tex.

[73] Assignee: PPG Industries, Inc., Pittsburgh, Pa.

[22] Filed: Oct. 3, 1973

[21] Appl. No.: 402,929

[44] Published under the second Trial Voluntary Protest Program on February 3, 1976 as document No. B 402,929.

[52] U.S. Cl. ..... 428/289; 162/153; 204/295; 427/372 R; 427/380; 427/399; 428/443

[51] Int. Cl.[2] ..... C25B 13/06; D21H 5/18; D04H 1/58; B05D 3/02

[58] Field of Search ..... 117/126 AF, 118, 119.6; 204/295; 162/153; 427/372, 380, 399; 428/289, 443

[56] References Cited

UNITED STATES PATENTS

| | | | |
|---|---|---|---|
| 737,557 | 8/1903 | Friswell | 162/153 |
| 984,915 | 2/1911 | Heltzen | 117/126 AF |
| 1,865,152 | 6/1932 | Stuart | 204/295 |
| 3,499,812 | 3/1970 | Glav | 117/126 AF |
| 3,597,514 | 8/1971 | Jager | 162/153 |
| 3,847,762 | 11/1974 | Strain | 204/295 |

*Primary Examiner*—Ralph Husack
*Assistant Examiner*—William H. Schmidt
*Attorney, Agent, or Firm*—Richard M. Goldman

[57] ABSTRACT

Disclosed is a method of preparing an asbestos diaphragm where alkali metal ions are provided from an aqueous alkaline solution within the fibrous asbestos diaphragm, the diaphragm is heated to form an alkali metal silicate layer on the asbestos fibers, and thereafter contacted with anolyte liquor.

3 Claims, No Drawings

TREATMENT OF ASBESTOS DIAPHRAGMS AND RESULTING DIAPHRAGM

BACKGROUND OF THE INVENTION

Diaphragm cells useful for the electrolysis of brines and the formation of chlorine and caustic soda have an anolyte chamber and a catholyte chamber. The anolyte chamber contains an anolyte solution of sodium chloride at a pH of from about 3.0 to about 4.5. Inside the anolyte chamber is an anode at which chlorine is evolved. The catholyte chamber of a sodium chloride chlor-alkali cell contains from about 10 to 15 weight percent sodium hydroxide while the catholyte chamber of a potassium chloride chlor-alkali cell may contain as much as 25 weight percent potassium hydroxide. The catholyte liquor contains the alkali metal hydroxide, and the alkali metal chloride. Alkali metal hydroxide is formed in the catholyte and hydrogen gas is evolved at the cathode.

In the operation of sodium chloride diaphragm cell, brine containing approximately 300 to 315 grams per liter of sodium chloride is fed into the anolyte chamber. At the anode, the reaction $2Cl^- \rightarrow Cl_2 + 2e^-$ takes place.

The anolyte liquor passes from the anolyte chamber through the diaphragm into the catholyte chamber, and a catholyte product containing from approximately 110 to approximately 150 grams per liter of sodium hydroxide and from approximately 120 to approximately 200 grams per liter of sodium chloride is recovered. In the catholyte chamber, the reaction $2H_2O + 2e^- \rightarrow 20H^- + H_2$ takes place.

Typically, diaphragms for chlorine cells have been prepared from asbestos. Most commonly, the asbestos is chrysotile asbestos. The chrysotile asbestos is used to provide a diaphragm having a thickness of from about ⅛ inch to about ¼ inch. Chrysotile asbestos diaphragms generally have a service life of about 6 months.

It is necessary to periodically remove the diaphragm cell from service in order to remove the old diaphragm from the cathodes, and install a new diaphragm on the cathodes. This periodic removal of the cell from service results in a consequent loss of production in order to carry out a labor-intensive cell renewal operation. In the past, when diaphragm cells used graphite anodes, diaphragm renewal could be coordinated with anode renewal. However, metallic anodes, e.g., coated titanium anodes, have replaced graphite anodes to a considerable degree. While graphite anodes have a service life of from about 4 to about 8 months, coated metal anodes have a longer life, e.g., 3 to 4 or more years. Accordingly, the renewal of the diaphragms has become a principal factor in cell outage.

SUMMARY

It has now unexpectedly been found that a particularly long-lived diaphragm may be provided by preparing a chrysotile asbestos fibrous mat containing alkali metal ions therein and heating the alkali metal ion containing fibrous mat to a temperature sufficient to dry the mat and cause the alkali metal ion to react with the asbestos. This is believed to displace the magnesium ion from the surface of the chrysotile asbestos fibers to form an alkali metal silicate layer on the asbestos fibers which, upon contact with the acid anolyte, forms a dense, uniform silica layer on the surface of the original asbestos fibers thereby providing a longlived diaphragm. Typically, the alkali metal is sodium and the alkali metal silicate is sodium silicate.

Commonly assigned co-pending application of Franklin Strain for *Silicate Treated Asbestos Diaphragms for Electrolytic Cells*, Ser. No. 343,600, filed Mar. 21, 1973, now U.S. Pat. No. 3,847,762 issued Nov. 12, 1974 teaches providing the silicate by contacting the deposited chrysotile asbestos with a water-soluble silicate after the deposition of the diaphragm. According to the present invention, a superior diaphragm may be prepared by providing alkali metal ions within the asbestos and reacting the alkali metal ions with the silicate ions of the asbestos to form alkali metal silicate.

DETAILED DESCRIPTION

According to this invention, an asbestos diaphragm is prepared by providing asbestos containing an alkali metal ion, such as an alkali metal hydroxide, or an alkali metal chloride, e.g., sodium hydroxide, sodium chloride, potassium hydroxide, or potassium chloride or a combination thereof. The alkali metal ion containing and hydroxyl ion containing, asbestos is heated to a temperature sufficient to initiate the displacement of magnesium from the asbestos and the formation of an alkali metal silicate surface or film on the asbestos and is maintained at or above such temperature long enough to form the alkali metal silicate. Upon contact with the anolyte liquor, the alkali metal silicate is believed to form a particularly tough, adherent silica layer which is substantially inert to anolyte liquor. That is, the silica layer is more inert to anolyte liquor than is a conventional diaphragm.

As used herein a fibrous mat is an asbestos member, formed from asbestos fibers. As used herein a diaphragm is an asbestos member, either a fibrous mat or asbestos paper, characterized by chemical resistance to anolyte liquors and catholyte liquors, and electrolyte permeability.

In preparing a diaphragm according to one exemplification of this invention, an aqueous slurry containing asbestos and alkali metal ion is prepared. The slurry is drawn through an electrolyte-permeable cathode member and the asbestos deposited on the cathode member thereby forming a fibrous asbestos mat. Thereafter the alkali metal ion containing fibrous asbestos mat is heated whereby to form the alkali metal silicate.

The asbestos most commonly used is chrysotile asbestos. Typically, the asbestos is Quebec Asbestos Producers' Association Quebec Screen Test grades 4D or 4K or a mixture of grades 3T and 4T.

Typically, the slurry contains from about 0.5 to about 2.0 weight percent of asbestos. Concentrations of asbestos lower than about 0.5 weight percent, while satisfactory in providing a diaphragm according to this invention, require large throughputs of slurry in order to build up a satisfactory thickness of asbestos. Asbestos concentrations greater than about 2 weight percent asbestos in the slurry, generally result in substantial settling out of the asbestos in the slurry and a non-uniform diaphragm.

The alkali metal ion content of the slurry is provided by a basic solution of an alkali metal compound. That is, the alkali metal ion is provided by a solution having a pH greater than 7.0, and preferably greater than 10. The alkali metal ion content may be provided by a solution of a high pH alkalic metal salt of a weak acid, such as sodium carbonate, sodium hydrogen carbonate, sodium acetate, or the like. Alternatively, the alkali metal content may be provided by a solution containing the hydroxide and a substantially completely ionized salt, as sodium hydroxide and sodium chloride. The alkali metal ion may also be provided by aqueous alkali metal hydroxide. Alternatively, potassium hydroxide or potassium chloride may be used to form the slurry.

Generally, sodium hydroxide is preferred as the alkali metal ion source because of its ready availability. While the method of preparing the diaphragm is described with reference to sodium hydroxide, it is to be understood that sodium chloride may also be included in the slurry with satisfactory results. The sodium ion content in the slurry should be such as is normally provided by a 10 weight percent to 50 weight percent aqueous solution of sodium hydroxide.

The slurry, preferably containing from about 0.5 to about 2 weight percent of chrysotile asbestos and from about 10 weight percent to about 25 or 50 weight percent of sodium hydroxide is used to prepare an asbestos diaphragm. The asbestos diaphragm is drawn onto a liquid permeable cathode member by methods well known in the art.

The cathode member itself is an alkali-resistant, catholyte-resistant, hydrogen-resistant, electroconductive metal having a low hydrogen overvoltage. Most commonly, iron or steel is used in fabricating the cathode member.

The cathode member is further characterized in that it is liquid permeable, i.e., electrolyte permeable, and gas permeable. The property of permeability may be provided by using a wire mesh cathode or by using a perforated plate cathode.

According to an exemplification of this invention, an alkali metal ion containing fibrous asbestos mat may be deposited on a cathode member by inserting the cathode member in an alkali metal ion and $OH^-$ ion containing aqueous slurry of asbestos and drawing a vacuum within the cathode member. By "vacuum" is meant a pressure differential between the inside and outside of the cathode. The vacuum draws the slurry through the cathode member, depositing the asbestos fibers on the external surfaces thereof. Typically, a vacuum of from about 15 to about 25 inches of mercury is provided within the cathode member for a period of from about 10 minutes to about 25 minutes. In this way, a fibrous asbestos mat having a thickness of from about ⅛ inch to about 3/16 inch and a weight of from about 0.3 pounds per square foot to about 0.4 pounds per square foot is provided.

While a preferred exemplification of this invention utilizes a deposited asbestos diaphragm, it should be understood that an electrolyte permeable diaphragm may also be provided using asbestos paper. According to an exemplification of this invention where an asbestos paper diaphragm is used, the alkali metal ion and $OH^-$ ion may be introduced into the asbestos paper by forming the paper in an alkali metal ion containing slurry. Alternatively, an alkali metal ion containing solution, e.g., aqueous sodium hydroxide may be forced through the asbestos paper after the formation thereof.

When sodium hydroxide is used, the asbestos diaphragm, whether a deposited fibrous mat or paper, should typically contain from about 5 weight percent to about 50 weight percent of sodium hydroxide on an anhydrous basis and a dry asbestos basis, and preferably about 35 to about 40 weight percent sodium hydroxide, basis anhydrous sodium hydroxide and dry asbestos. This corresponds to from approximately 10 percent to about 100 percent and preferably from about 60 percent to about 80 percent of the stoichiometric amount of sodium ion for one mole of sodium ion to react with one mole of silicate ion to form one mole of $Na_2O \cdot SiO_2$.

Lesser or greater amounts of sodium ion may be present in the fibrous asbestos mat, prepared as described above. Lesser amounts of sodium ion present in a fibrous asbestos mat, prepared as described above, while providing some increased life, may not provide an economically significant increase in diaphragm life. Greater amounts of sodium ion present in a fibrous asbestos mat, prepared as described above, while useful in providing increased diaphragm life, may tend to excessively tighten the diaphragm, causing it to behave as a permionic membrane, and may, at extremely high sodium ion concentrations actually reduce the strength of the diaphragm.

The sodium ion containing, asbestos member, either a fibrous mat or paper, is heated to a temperature sufficient to result in the formation of sodium silicate and is maintained at or above such temperature long enough to effect the desired degree of reaction. While not wishing to be bound by this explanation, it is believed that the following reaction occurs within the fibrous asbestos mat upon heating:

$$8M\ OH + Mg_6(OH)_8Si_4O_{10} \rightarrow 4M_2SiO_3 + 6Mg(OH)_2 + 2H_2O$$

where M is an alkali metal, generally sodium or potassium, and most commonly sodium.

While the heating stage itself may be in one or two stages, it can be characterized as encompassing two phases, a partial dehydration phase believed to drive off some of the water present therein while physically rearranging and compacting the asbestos fibers, and a reaction phase believed to form the alkali metal silicate in a form that reacts with anolyte liquor to form a silica which is less subject to attack by brine than chrysotile asbestos. In the heating stages of the method of this invention, the duration of heating, the temperature of heating, the initial moisture content of the asbestos, and the flow of heated air, if any, through the diaphragm, are inter-related.

Generally, the temperature during the first phase of heating should be above about 70°C, which temperature corresponds to the temperature at which some compacting and rearrangement of the asbestos fibers is first observed. Temperatures above about 110°C should be avoided in the early stages of heating, as such temperatures result in the delamination of wet diaphragms and subsequent high cell voltage and low current efficiency. Generally, the fibrous asbestos mat should be dried to a water content of less than 2.0 weight percent water, and preferably to 1.0 weight percent water, or even lower, e.g., 0.5 weight percent water. The temperature of the first heating stage should be above 50°C and below 110°C, and generally from about 70°C to 110°C. The length of the first heating should range from about 72 or more hours at 50°C and about 24 hours at 70°C to about 1 to 4 hours at 110°C, and should be long enough to permit the second stage of heating to be substantially in the absence of entrapped or entrained water.

While a first heating stage is referred to herein, it is to be understood that the first heating stage functions as a drying phase and may even be dispensed with if a vacuum is first applied to the cathode compartment to dry, physically rearrange, and compact the fibers. In such case, the vacuum should be a full vacuum, i.e., 20 or more inches of mercury.

The first heating stage, or dehydration stage, is followed by a subsequent heating stage to form the desired silicate. This second heating stage is conducted at temperatures above about 110°C, e.g., from about 110°C to about 280°C, and preferably from about 140°C to about 210°C.

At temperatures below 140°C, approximately several days, e.g., 4 or 5 days, may be required for the alkali metal silicate to approach stoichiometric conversion to the desired form, while at temperatures at or above 180°C only a few hours, e.g., 2 hours with low alkali metal ion contents, to about 4 or 6 hours, are normally required for the formation of the desired form of the alkali metal silicate.

While the flow of heated air through the electrolyte permeable fibrous mat does not result in any decrease in the time required for silicate formation, it does result in removal of entrapped water, thereby reducing overall drying time.

The heating may also be carried out under reduced pressure to speed the drying time.

In the preparation of a diaphragm according to a preferred exemplification of this invention, the asbestos mat is maintained between about 50°C and about 110°C for a sufficient time to allow the evaporation of the entrapped water, e.g., at least about 1 hour, and preferably 4 or more hours, and frequently 72 to 96 hours. Maintaining the asbestos mat between about 50°C and 110°C may be accomplished by slowly heating the diaphragm from or below 50°C to or above 110°C, or by maintaining the asbestos mat at a fixed temperature or plurality or sequence of fixed temperatures between 50°C and 110°C. Thereafter the asbestos mat is maintained above 110°C, e.g., from about 110°C to about 280°C, and preferably from about 140°C to about 210°C. Maintaining the asbestos mat above about 110°C may be accomplished by maintaining the asbestos mat at a single temperature above 110°C, e.g., 140°C, or 180°C, or by maintaining the asbestos at a sequence of temperatures above about 110°C. The asbestos mat is maintained above 110°C long enough for substitution of the magnesium ion by the alkali metal ion and the formation of the alkali metal silicate, e.g., from about 2 or 4 or 6 hours to several days, e.g., 96 or 120 or more hours. The mat is maintained above 110°C in the substantial absence of entrapped or entrained water.

According to this invention, a surface film is formed on the asbestos fibriles and in some instances on the individual fibers thereof. The surface film may exist as a thin layer or coating on the exterior of the individual fibers or even as a monolayer of alkali metal silicate. Alternatively, the alkali metal silicate layer may extend into, and in fact all the way through the individual asbestos fibers.

According to this invention, the alkali metal silicate layer is provided on the asbestos fibers. For example, when the alkali metal is sodium, the sodium silicate has the stoichiometric formula: $(Na_2O)\ (SiO_2)_n$ where n is from about 1 to about 4 or more. However, it should be understood that this is only a stoichiometric representation of a complex silicate polymer containing many $(Na_2O)$ units and many $(SiO_2)$ units.

When the diaphragm is contacted with a low pH solution, e.g., anolyte liquor, having a pH of about 4.5 and preferably 4.0 or even lower, e.g., 3.5 or 2.9 or lower, the silicate reacts to form a particularly tough adherent silica that is thereafter substantially inert to attack by the anolyte.

Diaphragms produced as described above are characterized by long life and mechanical durability. Such diaphragms have a service life in excess of one year and frequently in excess of 18 months or longer. Such diaphragms are further characterized by a transverse wet tear strength in excess of 4.4 pounds per inch, compared to an effectively zero wet tear strength for untreated asbestos diaphragms.

Diaphragms prepared as described above are additionally characterized by the substantial absence of a gel layer and significantly reduced swelling in cell service.

The "gel layer" is described by Kircher, "Electrolysis of Brines in Diaphragm Cells," in Sconce, ed., *Chlorine*, A.C.S. Monograph Series, No. 54, Reinhold Publishing Company, New York, New York (1962), at page 105, as a layer "formed within the asbestos mat which is sensitive to pH and which tends to dissolve, precipitate, and reform depending upon flow rate and salt content and pH of the flowing liquor." As a rule, in an untreated diaphragm the "gel layer" extends approximately 0.08 to 0.12 inch into the diaphragm from the anolyte side. The alkali metal ion treatment and heating of the diaphragm according to this invention appears to substantially retard the formation of the gel layer. Diaphragms prepared according to this invention are characterized by increased physical strength so as to withstand the erosiveness of the gas bubble filled anolyte stream flowing against it.

While the methods described hereinabove may be used as the sole treatment for the asbestos diaphragms, it is to be understood that other methods may be used herewith to provide a diaphragm of particularly long life. Such methods typically involve application of a suitable reagent to the anolyte facing surface of the diaphragm, e.g., to provide further chemical and physical resistance and electrolyte wetability by providing a tough, adherent binder between asbestos fibers or to provide a tough, adherent film on individual asbestos fibers and fibriles.

For example, a silicate solution may be applied to the anolyte facing surface of the diaphragm, for example as described in U.S. Pat. application Ser. No. 343,600, filed Mar. 31, 1973, now U.S. Pat. No. 3,847,762 issued Nov. 12, 1974 by Franklin Strain for *Silicate Treated Asbestos Diaphragms for Electrolytic Cells*. The solution deposited silicate appears to coat the individual fibers and fibriles and size them together. Additionally, the asbestos may be treated with a perfluorinated, sulfonic acid material such as a surfactant or an ion exchange resin as described in the commonly assigned copending application of W. Bruce Darlington, and Robbie T. Foster for *Diaphragms for Electrolytic Cells*, Ser. No. 300,151, filed Oct. 24, 1972 now U.S. Pat. No. 3,853,721. Such material appears to reduce the tendency of the asbestos diaphragm to form a gel, while improving the wetability of the diaphragm.

Additionally, a further layer of asbestos may be deposited atop the asbestos diaphragm prepared as described herein. This further layer of asbestos, applied after heating the diaphragm and prior to placing the diaphragm-cathode assembly in the cell, need only be a thin layer of asbestos, e.g., from about 0.01 to about 0.1 pounds of asbestos per square foot, and preferably from about 0.03 to about 0.07 pounds per square foot. This additional coat or layer of asbestos appears to provide a 2 to 4 percent increase in current efficiency.

While a method of this invention is disclosed wherein the alkali metal hydroxide content of the fibrous asbestos mat is controlled and determined by the alkali metal ion concentration of the aqueous slurry, it is to be understood that after deposition of the diaphragm on the cathode member, an aqueous solution of alkali metal hydroxide may be forced through the diaphragm whereby to provide additional alkali metal hydroxide within the fibrous asbestos mat. The following examples are illustrative.

EXAMPLE I

An asbestos diaphragm was drawn from an aqueous slurry of asbestos in sodium chloride and sodium hydroxide, heated, and utilized as a diaphragm in a chlorine diaphragm cell.

A slurry, containing 15.0 weight percent sodium chloride, 10.4 weight percent sodium hydroxide, and 0.86 weight percent Johns-Manville Grade 4D-12 asbestos was prepared. The slurry had a density of 76.4 pounds per cubic foot.

Approximately a week after preparing the slurry, a diaphragm was then pulled onto the cathode of a laboratory diaphragm cell from the slurry. The laboratory electrolytic diaphragm cell had a 1000 cubic centimeter capacity catholyte compartment fabricated of 10 gauge steel sheet, and an anolyte compartment having a 1000 cubic centimeter capacity fabricated of chlorinated polyvinyl chloride. The anode, measuring 5 inches by 7 inches, was 1/16 inch Grade-1 titanium mesh coated with platinum and iridium. The cathode was 6 by 6 mesh to the inch, 3/16 inch, number 13 steel screen. The gap between the anode and the cathode in the assembled cell was variable between ⅛ inch and ⅜ inch.

The cathode assembly, with the asbestos mat on it was placed in an oven. A vacuum line was connected to the catholyte overflow line of the cathode assembly, and the hydrogen outlet left open, thereby providing air circulation to the back of the asbestos mat.

The cathode assembly was then heated at 95°C for 5 hours, and then at 180°C for 101.5 hours. The cell was then assembled.

Electrolysis was commenced with a brine feed containing approximately 312 grams per liter of sodium chloride and having a pH of about 10.3 to 11.0. Electrolysis was commenced at a current density of 190 amperes per square foot. For the first 20 days, the anode to cathode gap was ⅜ inch. The cell was then disassembled, the diaphragm examined and found to have undergone very little if any swelling and to have very little gel or slime formation.

Electrolysis was then continued at an anode to cathode gap of ⅛ inch. After 80 days of electrolysis the cell was operating satisfactorily with an anode to cathode voltage of 3.40 volts, an anode efficiency of 96 percent based on chlorine analysis, a cathode efficiency of 94 percent based on caustic analysis, a power demand of 2430 D.C. kilowatt hours per ton of chloride, and a brine head of 40 inches. The chlorine gas contained 1.4 percent oxygen, by volume.

EXAMPLE II

Five diaphragms were forced from the same slurry of chrysotile asbestos in aqueous sodium hydroxide and sodium chloride, heated and utilized as diaphragms in three chlorine diaphragm cells. The diaphragms differed only in the degree of agitation of the slurry.

A slurry was prepared containing 15 weight percent sodium chloride, 11.5 weight percent sodium hydroxide, and 1.0 weight percent of a mixture of one part Johns-Manville 3T chrysotile asbestos and two parts Johns-Manville 4T chrysotile asbestos. The slurry was agitated by bubbling air through it.

Five diaphragms of approximately 0.33 to 0.36 pounds per square foot were pulled from the slurry onto a cathode screen as described in Example I above. Each diaphragm was heated at 95°C for 4 hours pulling air through the diaphragm as described in Example I above. Then each diaphragm was heated at 180°C for 16 hours, pulling heated air through as described in Example I above. Then each diaphragm was heated at 180°C while applying a vacuum of 10 to 15 inches of mercury to the back side of the cathode screen for 4 hours.

Thereafter, the cells were assembled and electrolysis was commenced with a brine containing approximately 310 grams per liter of sodium chloride. Electrolysis was conducted at a current density of 190 amperes per square foot and an anode to cathode spacing of ⅜ inch. The results obtained with each of the five diaphragms are summarized in Table I.

TABLE I

Effect of Slurry Agitation on Heat Treated Diaphragm

| | | | | | |
|---|---|---|---|---|---|
| Agitation Time (hours) | 1.00 | 1.25 | 2.00 | 4.00 | 8.25 |
| Cell Voltage (volts) | 4.65 | 3.59 | 3.60 | 3.45 | 3.30 |
| Diaphragm IR Drop (volts) | — | 1.23 | 1.35 | 1.00 | 0.97 |
| Brine Head (inches water) | 52 | 27 | 28 | 26 | 25 |
| Anode Current Efficiency (%) | — | — | 96 | 94 | 92 |
| Cathode Current Efficiency (%) | 99 | 94 | 98 | 92 | 96 |
| Chlorate (% AB) in Catholyte | — | — | 0.12 | 1.1 | 0.38 |
| Hydrogen in Chlorine (%) | 0.05 | 0.09 | 0.04 | 0.04 | 0.06 |
| Oxygen in Chlorine (%) | 1.61 | 3.18 | 1.72 | 1.77 | 2.01 |
| Data determined as of days on line | 3 | 3 | 17 | 14 | 17 |

EXAMPLE III

A diaphragm was drawn from a slurry of 1.7 weight percent chrysotile asbestos (one part Johns-Manville 3T asbestos to two parts Johns-Manville 4T asbestos), 15.5 weight percent sodium chloride, and 11.5 weight percent sodium hydroxide, washed free of cell liquor, and dried. It was then cut into twelve strips.

Each strip was then soaked in aqueous sodium hydroxide and weighed to determine the amount of solution and sodium hydroxide taken up. The strips were then dried at 110°C for 4 hours.

The strips were then soaked in an aqueous solution of 310 grams per liter sodium chloride, adjusted to a pH of 3, at a temperature of 25°C and the transverse wet strength and uptake of water were measured. The data are presented in Table II below.

TABLE II

Effect of NaOH Content on Wet Strength and Water Content of Water Soaked Asbestos

| Grams of Solution per Gram of Asbestos | NaOH Concentration of Solution (wt. %) | Grams of NaOH per Gram of Asbestos | Wet Strength Kilograms/Inch | Swelling Grams of Water Absorbed per Gram of Asbestos |
|---|---|---|---|---|
| 1.4 | 0 | 0.00 | 0.0 | 4.54 |
| 1.9 | 5 | 0.10 | 0.4 | 1.49 |
| 1.6 | 10 | 0.16 | 0.9 | 0.95 |
| 2.0 | 15 | 0.31 | 1.7 | 0.45 |
| 1.9 | 20 | 0.38 | 1.9 | 0.58 |
| 1.8 | 25 | 0.45 | 1.8 | 0.55 |
| 2.4 | 30 | 0.72 | 2.7 | 0.74 |
| 2.8 | 35 | 0.98 | 1.8 | 0.71 |
| 2.5 | 40 | 1.00 | 2.3 | 0.75 |
| 2.8 | 45 | 1.24 | 0.9 | 0.80 |
| 2.7 | 50 | 1.35 | 0.9 | 1.07 |
| 3.5 | 55 | 1.95 | 0.2 | 1.19 |

EXAMPLE IV

Thirty mil Johns-Manville chrysotile asbestos paper was soaked in cell liquor, dried, heated at an elevated temperature, and utilized as a chlorine cell diaphragm in a chlorine cell of the type described in Example I.

A 6 inch by 8 inch 30 mil Johns-Manville chrysotile asbestos paper sheet was clamped onto a cathode with the smooth side facing away from the cathode. The diaphragm was then soaked in cell liquor containing 14 weight percent sodium chloride and 10 weight percent sodium hydroxide for one hour.

Seven hundred milliliters of cell liquor was then forced through the asbestos paper diaphragm under a vacuum of 2 inches of mercury. Air was then forced through the diaphragm under a vacuum of 2 inches of mercury for 20 minutes. The diaphragm was then heated for 91.7 hours at 85°C with air circulation behind the diaphragm.

Thereafter the diaphragm was heated to 180°C for 24 hours with air circulation behind the cathode. Thereafter the electrolytic cell was assembled and electrolysis was commenced with a brine feed containing 310 to 315 grams per liter of sodium chloride. At an anode to cathode gap of ⅛ inch and a current density of 400 amperes per square foot, the following results were obtained:

| Days on Line | 7 | 14 | 21 |
|---|---|---|---|
| Voltage | 3.27 | 3.18 | 3.24 |
| Temp., °C | 80 | 90 | 93 |
| Brine Level, in. | 16 | 15 | 14 |
| % $H_2$ in Chlorine | 0.05 | 0.72 | 1.04 |
| % $O_2$ in Chlorine | 1.62 | 1.73 | 1.09 |
| Anode Eff. | 93.7 | 92.9 | 93.4 |
| Cathode Eff. | 92.8 | 93.5 | 92.3 |
| Catholyte % NaOH | 9.51 | 10.00 | 8.77 |
| Catholyte % $NaClO_3$ (Anhydrous Basis) | 0.74 | 0.50 | 1.03 |
| Brine % Depletion | 48.6 | 50.9 | 46.7 |
| Anolyte % $NaClO_3$ | 0.20 | 0.18 | 0.17 |

-continued

| Days on Line | 7 | 14 | 21 |
|---|---|---|---|
| Anolyte pH | 4.6 | 4.9 | 4.1 |

EXAMPLE V

A 30 mil Johns-Manville chrysotile asbestos paper sheet was soaked in cell liquor, dried, heated at an elevated temperature, and utilized as a chlorine cell diaphragm in a chlorine cell of the type described in Example I.

A 5 inch by 7 inch 30 mil Johns-Manville chrysotile asbestos paper sheet was clamped onto a cathode with the smooth side facing away from the cathode. The diaphragm was then soaked in cell liquor containing 15 weight percent sodium chloride and 10 weight percent sodium hydroxide for 1 hour.

Cell liquor was then forced through the asbestos paper diaphragm under a vacuum of 2 inches of mercury. Air was then passed through the diaphragm under a vacuum of 2 inches of mercury for 30 minutes. The diaphragm was then heated for 19.5 hours at 75°C and for 7.5 hours at 95°C.

The diaphragm was then heated to 180°C for 24 hours with air circulation behind the cathode. Thereafter the electrolytic cell was assembled and electrolysis was commenced with a brine feed containing 310 to 315 grams per liter of sodium chloride. At an anode to diaphragm gap of ⅛ inch and a current density of 400 amperes per square foot, the following results were obtained:

| Days on Line | 7 |
|---|---|
| Voltage | 3.28 |
| Temp.,°C | 90 |
| Brine Level, in. | 15 |
| % $H_2$ in Chlorine | 0.09 |
| % $O_2$ in Chlorine | 1.13 |
| Anode Eff. | 94.6 |
| Cathode Eff. | 92.8 |
| Catholyte % NaOH | 9.51 |
| Catholyte % $NaClO_3$ (Anhydrous Basis) | 0.21 |
| Brine % Depletion | 48.2 |
| Anolyte % $NaClO_3$ | 0.14 |
| Anolyte pH | 4.5 |

EXAMPLE VI

A 60 mil Johns-Manville chrysotile asbestos paper sheet was soaked in cell liquor, dried, heated at an elevated temperature, and utilized as a chlorine cell diaphragm in a chlorine cell of the type described in Example I.

A 6 inch by 8 inch 60 mil Johns-Manville chrysotile asbestos paper sheet was clamped onto a cathode with the smooth side facing up. The diaphragm was then soaked in cell liquor containing 14 weight percent sodium chloride and 10 weight percent sodium hydroxide for one hour.

The diaphragm was then heated for 4 hours at 95°C with air circulation behind the diaphragm.

The diaphragm was heated to 180°C for 16.5 hours with air circulation behind the cathode. Thereafter the electrolytic cell was assembled and electrolysis was commenced with a brine feed containing 310 to 315 grams per liter of sodium chloride. At an anode to cathode gap of ⅜ inch and a current density of 400 amperes per square foot, the following results were obtained:

| Days on Line | 14 | 21 |
|---|---|---|
| Voltage | 4.17 | 3.73 |
| Temp., °C | 90 | 86 |
| Brine Level, in. | 17 | 43 |
| % $H_2$ in Chlorine | 0.13 | .05 |
| % $O_2$ in Chlorine | 3.94 | 2.06 |
| Anode Eff. | 77.3 | 94.2 |
| Cathode Eff. | 83.8 | 90.15 |
| Catholyte % NaOH | 15.71 | 13.84 |
| Catholyte % $NaClO_3$ (Anhydrous Basis) | 0.78 | 1.73 |
| Brine % Depletion | 75.0 | 67.9 |
| Anolyte $NaClO_3$% | 1.43 | 1.16 |
| Anolyte pH | 4.6 | 4.6 |

EXAMPLE VII

A chrysotile asbestos diaphragm was forced on a steel cathode, heated, and then installed in a diaphragm cell and electrolysis commenced.

A slurry was prepared containing about 1.5 weight percent of one part of Johns-Manville 3T chrysotile asbestos and two parts of Johns-Manville 4T chrysotile asbestos in an aqueous liquid composition of 15 weight percent sodium chloride and 10 weight percent sodium hydroxide. The cathodic portion of a laboratory diaphragm cell, having a planar iron mesh cathode, was placed in the slurry, a vacuum tube inserted on the perk pipe, the hydrogen outlet plugged, and a vacuum drawn across the cathode screen. A vacuum of 3.5 inches of mercury was drawn for 8 minutes, a vacuum of 15 inches of mercury was then drawn for 2 minutes, and a vacuum of 20 inches of mercury was drawn for 7 and ½ minutes. The slurry was forced through the cathode screen depositing asbestos on the screen.

The cathode assembly, including the deposited asbestos, was then heated to 90°C to 95°C for 20 hours, and thereafter to 180°C for 92 hours.

The cathodic half of the cell, and the anodic half of the cell having an Electrode Corporation "DSA" anode, were assembled. Electrolysis was commenced at an anode current density of 200 amperes per square foot and the following results were obtained:

| Days of Operation: | 4 | 12 | 18 | 26 | 33 | 39 | 57 | 67 | 77 | 82 |
|---|---|---|---|---|---|---|---|---|---|---|
| Catholyte (grams per liter): | | | | | | | | | | |
| NaOH; | 117.6 | 122.0 | 115.2 | 118.0 | 119.2 | 116.0 | 116.0 | 115.0 | 115.2 | 112.0 |
| NaCl; | 177.6 | 163.1 | 170.7 | 172.4 | 167.6 | 173.5 | 169.5 | 174 | 175.3 | 171.8 |
| $NaClO_3$; | 0.15 | 0.26 | 0.21 | 0.30 | 0.25 | 0.34 | 0.28 | 0.25 | 0.30 | 0.25 |
| Anolyte: | | | | | | | | | | |
| pH; | 3.55 | 3.75 | 3.65 | 3.80 | 3.55 | 3.78 | 3.70 | 4.20 | 4.10 | 4.10 |
| $NaClO_3$; (grams per liter) | 0.92 | 0.89 | 0.52 | 1.05 | 0.75 | 0.83 | 0.86 | — | 0.90 | 1.24 |
| Cell Gas (volume percent): | | | | | | | | | | |
| $Cl_2$; | 98.17 | 97.43 | 97.10 | 97.72 | 97.85 | 98.03 | 97.8 | 98.3 | 98.2 | 98.1 |
| $H_2$; | 0.19 | 0.29 | 0.29 | 0.27 | 0.15 | 0.12 | 0.31 | 0.19 | 0.15 | 0.12 |
| $O_2$; | 1.16 | 1.76 | 1.49 | 1.43 | 1.44 | 1.51 | 1.49 | 1.42 | 1.31 | 1.46 |
| Cell Voltage: | 3.57 | 3.75 | 3.65 | 3.80 | 3.55 | 3.56 | 3.70 | 4.70 | 4.10 | 4.00 |

Although the present invention has been described with reference to specific details of particular embodiments thereof, it is not intended thereby to limit the scope of the invention except insofar as specific details are recited in the appended claims.

We claim:

1. A fibrous chrysotile asbestos mat having a wet tear strength in excess of 4.4 pounds/inch and containing the reaction product formed by contacting a moist asbestos mat with alkali metal hydroxide in an aqueous alkaline solution whereby to provide alkali metal ion within the mat in an amount of from about 10 to about 100 percent of the stoichiometric amount of alkali metal ion for one equivalent of alkali metal ion to react with one equivalent of silicate ion of the asbestos, drying the asbestos to substantial dryness, and heating the dried asbestos mat to above 110°C. and below about 280°C. for more than 2 hours.

2. A method of treating an electrolyte permeable asbestos sheet which method comprises:

providing alkali metal hydroxide in the sheet in an amount of from about 10 to about 100 percent of the stoichiometric amount of alkali metal ion for one equivalent of alkali metal ion to react with one equivalent of silicate ion of the asbestos;

rendering the sheet substantially free of water; and thereafter heating the sheet in the substantial absence of water to between 110°C. and 280°C. for more than 2 hours to provide a wet tear strength in excess of 4.4 pounds/inch.

3. The method of claim 2 wherein the sheet is heated for between 2 and 100 hours.

* * * * *